United States Patent [19]

de Calvino y Teijeiro

[11] Patent Number: 4,510,359

[45] Date of Patent: Apr. 9, 1985

[54] CIRCUIT INTERRUPTER HAVING IMPROVED CLOSING RESISTOR CONTROL MEANS

[75] Inventor: Ben J. de Calvino y Teijeiro, Monroeville, Pa.

[73] Assignee: Westinghouse Electric Corp., Pittsburgh, Pa.

[21] Appl. No.: 549,856

[22] Filed: Nov. 8, 1983

[51] Int. Cl.[3] ..... H01H 33/16

[52] U.S. Cl. ..... 200/144 AP; 200/148 R; 200/148 D; 200/148 F; 200/145

[58] Field of Search ..... 200/144 AP, 148 R, 145, 200/148 D, 148 F

[56] References Cited

U.S. PATENT DOCUMENTS

| | | | |
|---|---|---|---|
| 3,291,947 | 12/1966 | Van Sickle | 200/144 AP |
| 4,072,836 | 2/1978 | Bischofberger et al. | 200/144 AP |
| 4,443,674 | 4/1984 | Calvino | 200/148 D |

*Primary Examiner*—Robert S. Macon
*Attorney, Agent, or Firm*—D. S. Buleza

[57] ABSTRACT

Sporadic malfunctions of the closing resistor mechanism employed in a power circuit breaker to connect a resistor in parallel with the breaker contacts (prior to closing of such contacts) is prevented by providing an improved control and actuating means for the resistor mechanism which insures that the latter is reliably reset for use each time the breaker is operated. A self-adjustable component, such as a spring-loaded link, is inserted in the tie-rod structure which couples the breaker operating lever to the closing resistor operating lever. The resulting "elastic" coupling action automatically positions the levers in the proper relationship for resetting of the resistor mechanism despite small variations in the complete-open position of the breaker operating mechanism and linkage system.

8 Claims, 14 Drawing Figures

CIRCUIT INTERRUPTER HAVING IMPROVED CLOSING RESISTOR CONTROL MEANS

CROSS-REFERENCE TO RELATED APPLICATION

This application discloses and claims subject matter which constitutes an improvement over that disclosed and claimed in pending application Ser. No. 364,038 of Ben J. Calvino, filed Mar. 31, 1982, entitled "Circuit Interrupter Closing Resistance Mechanism", which application is assigned to the assignee of the present application.

BACKGROUND OF THE INVENTION

This invention generally relates to circuit interrupter apparatus and, more particularly, to a high-voltage circuit breaker having an integral mechanism which places a closing resistance in parallel with the main contacts of the circuit breaker in a controlled reliable manner during the operation of the breaker.

As is well known in the art, when a high-voltage transmission line is closed voltage surges may be produced that exceed the insulation level of the line and thus cause destructive flashovers. Such voltage surges are suppressed by inserting a resistance of the proper value into the line in parallel with the contacts of the circuit interrupter just before the contacts the closed. Prior art circuit breakers having such closing resistor means are disclosed in U.S. Pat. Nos. 3,291,947 (Van Sickle) and 4,072,836 (Bischofberger et al.).

When interrupting very high voltages (voltages in the range of 500 kilovolts, for example), two or more interrupting units are employed in series to provide the required interrupting capacity. The use of such multiple interrupter units presents synchronizing problems when closing on an energized transmission line, particularly when closing resistors are employed for each of the interrupter units. In order for the resistors to provide the desired surge-suppression protection, it is essential that the impedance contacts of each of the interrupter units close a very short time (10 milliseconds, for example) before the closing of the circuit breaker contacts. During the opening operation of the circuit breaker, the resistors serve no function and thus should not be in the circuit. The impedance contacts are accordingly opened a few milliseconds after the interrupter contacts are closed, thereby removing the resistors from the circuit and resetting the circuit interrupter for the next cycle of operations. An integral linkage and closing resistance control assembly for automatically closing and opening the resistor contacts in the proper time sequence relative to the operation of the circuit-breaker units is disclosed and claimed in the aforementioned pending Calvino application Ser. No. 364,038.

While the unique resistor operating mechanism provided by the linkage and mechanical-timing assembly described in the aforesaid Calvino application functioned in a satisfactory manner during tests and early use in the field, it was subsequently discovered that the mechanism would occasionally fail to operate properly and permitted the circuit-breaker contacts to close without the prior insertion of the resistors into the circuit. Investigation and field test revealed that these sporadic malfunctions were caused by the random failure of the resistor operating and control mechanism to reset properly due to small variations in the "complete open" position of the circuit breaker operating linkage and mechanism. Such variations are caused by unavoidable manufacturing tolerances in the various components of the breaker and the differences in the manner in which the components are adjusted and coact with one another in a given breaker. Since resetting of the resistor control mechanism requires that a pair of apertures in a drive shaft (which is coupled to the breaker operating mechanism and breaker contacts) be perfectly aligned with matching pairs of apertures in a rotatable drive lever and free wheel cam to permit a pair of free rollers to shift position and latchingly engage the drive lever instead of the cam, even the slightest misalignment of the various paired apertures prevented the free rollers from shifting position and engaging the drive lever of the closing-resistor mechanism so that it could be rotated into reset position (along with the closing resistor contacts which are coupled to the drive lever).

SUMMARY OF THE INVENTION

The present invention solves the aforementioned erratic resetting of the resistor operating and control mechanism by inserting a self-adjustable elastic component in the tie rod which couples the operating lever of the circuit breaker to the operating lever of the closing resistor control mechanism. The resulting "elastic" coupling of the two operating levers automatically compensates for minor variations in the "complete open" position of the circuit breaker linkage and components and thus ensures that the three pairs of apertures of the resistor operating and control mechanism will be properly aligned during the opening operation and permit the closing resistor control mechanism to be reset in a positive reliable fashion every time the circuit breaker is operated.

In accordance with a preferred embodiment of the invention, the self-adjustable component comprises a spring-loaded link that is inserted into the rigid one-piece tie rod which was heretofore employed to couple the operating levers of the circuit breaker and closing resistor control assembly to one another.

BRIEF DESCRIPTION OF THE DRAWINGS

A better understanding of the invention will be obtained from the exemplary embodiment illustrated in the accompanying drawings, wherein:

FIGS. 5A to 8A are schematic diagrams showing the positions of the circuit breaker contacts and closing resistor contacts corresponding to the various positions of the resistor operating-control mechanism depicted in FIGS. 5 to 8.

DESCRIPTION OF THE PREFERRED EMBODIMENT

Figure 1:
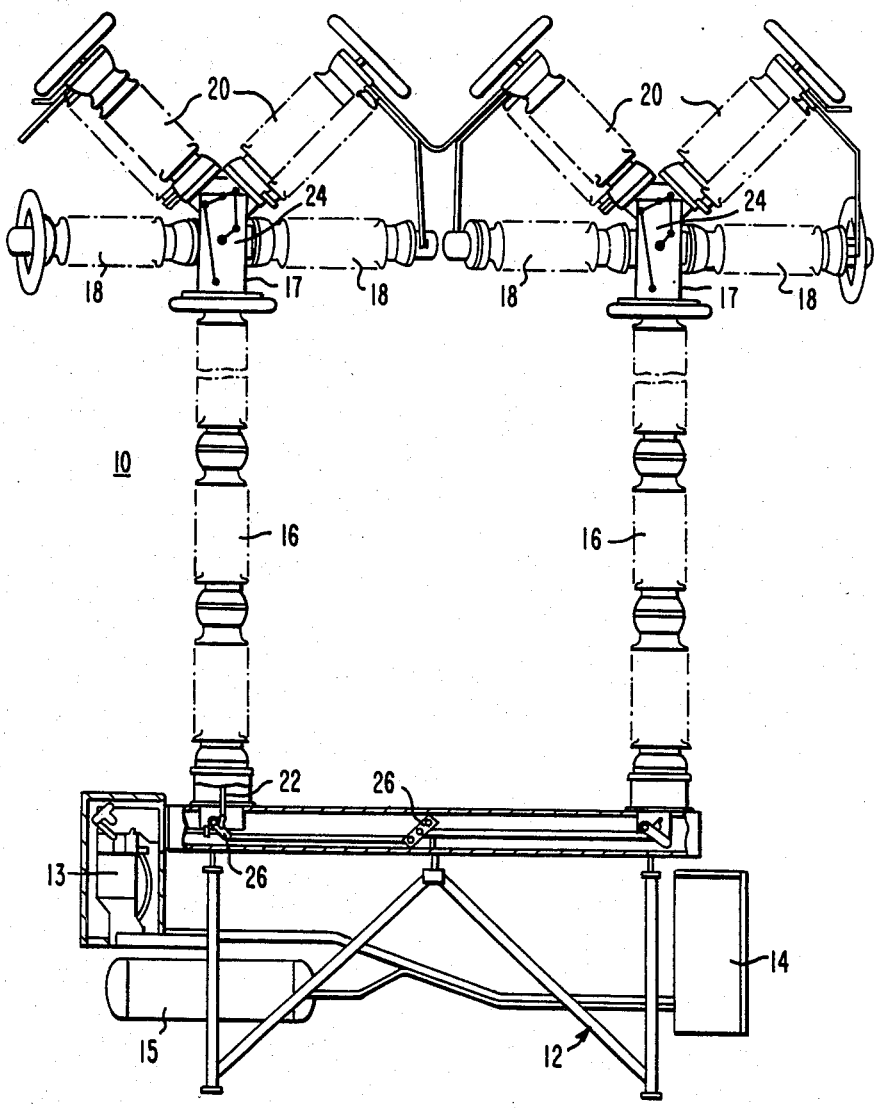
FIG. 1 is an elevational view of a puffer type compressed gas power circuit breaker having the improved closing resistor control mechanism of the present invention.

Referring now to the drawings in detail, in FIG. 1 there is shown a puffer type compressed gas power circuit breaker 10 representative of the general type of circuit interrupter apparatus which can advantageously employ the improved closing resistor control mechanism of the present invention. Power circuit breaker 10 includes the usual frame 12 which supports the breaker operating mechanism 13, control cabinet 14, compressed air tank 15, and a pair of procelain support columns 16 which support the closing resistor modules 18 and circuit-interrupting modules 20 and insulate such modules from the grounded frame 12. Within each support column 16 there is disposed a glass epoxy operating rod 22 which connects the external linkage 24 assembly for the interrupter and closing resistor modules to the main linkage 26 which is connected to and actuated by the operating mechanism 13. The external linkage 24 is mounted on the outside of the breaker housing adjacent the modules 18, 20 and is protected by a cover panel (not shown).

Figure 2:
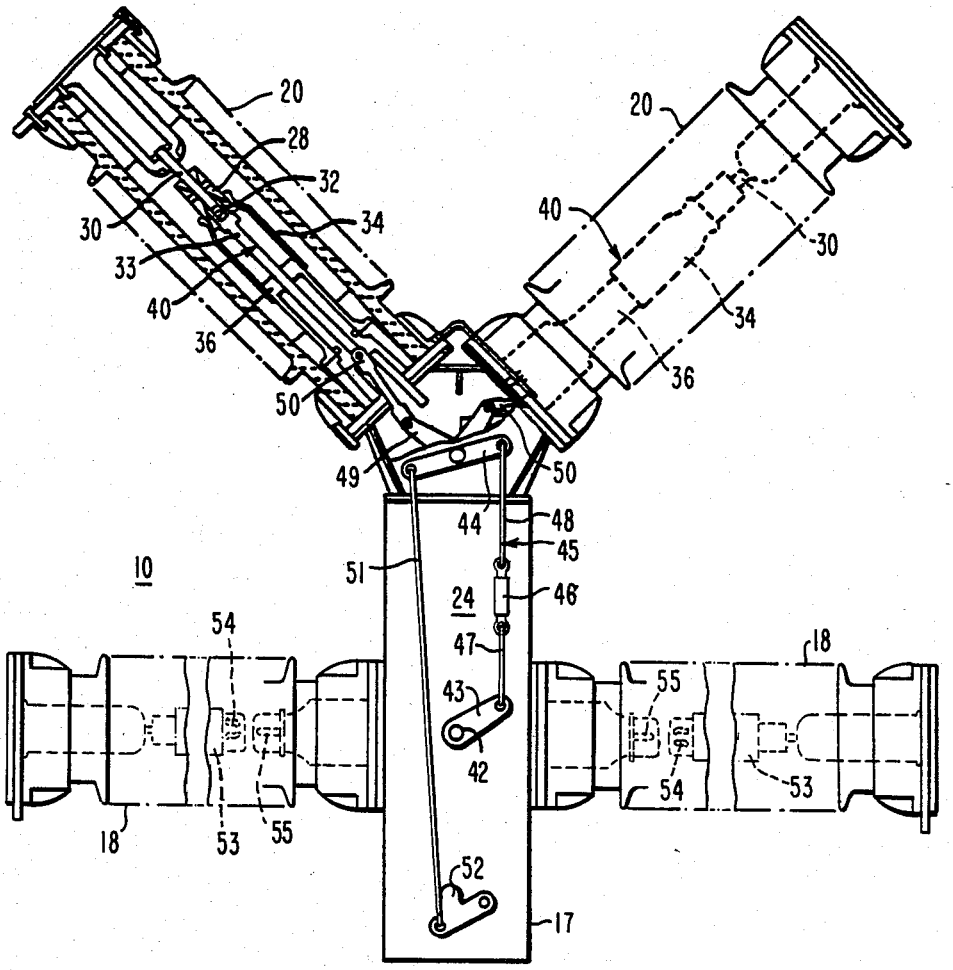
FIG. 2 is an enlarged elevational view of a top portion of the circuit breaker shown in FIG. 1, one of the interrupter modules being shown in cross-section and a cover being removed from the associated portion of the sport column to expose the external linkage for the interrupter and closing resistor mechanisms.

As illustrated in FIG. 2, each of the interrupter modules 20 include the usual arc chamber 28, a stationary contact 30 and a movable contact 32 which is secured by a connector rod 33 to a movable cylinder 34 that coacts with a stationary piston 36 to provide a puffer assembly 40 which suppresses the arc produced when the breaker contacts are opened. The interrupter modules 20 are filled with a suitable insulating gas (such as sulfur hexafluoride) and, when the circuit breaker 10 is actuated to open the power line, the puffer assembly 40 automatically compresses the insulating gas and blasts it into the gap between the parting breaker contacts 30, 32 to quickly extinguish the arc in the well-known manner.

As will be noted, the resistor modules 18 extend laterally from the top portion 17 of the associated support column 16 and are aligned with a rotatable seal shaft 42 that is coupled to the external linkage assembly 24. Shaft 42 constitutes the drive shaft which actuates the resistor operating and control mechanism through a mechanical clutch and latch mechanism that is located within the top portion 17 of the support column 16 and is hereinafter described. The drive shaft 42 is rigidly secured to a resistor-operating lever 43 and, in accordance with the present invention, this lever is coupled to the circuit-breaker operating lever 44 by a tie-rod assembly 45 consisting of an elastic medial component 46 that is connected to the respective levers 43, 44 by a pair of short rods 47, 48. Operating lever 44 is coupled (as illustrated in FIG. 2) to the phase lever system 49 which is located within the circuit-breaker housing and actuates, through suitable linkage members 50, the moveable contacts 32 and puffer assemblies 40 of the respective interrupter modules 20. The external linkage assembly 24 also includes a rigid tie rod 51 that couples the circuit breaker operating lever 44 to another lever 52 that is connected to and actuated by the glass epoxy rod 22 (not shown) located within the support column 16 and coupled to the operating mechanism 13 of the circuit breaker 10.

As will also be noted in FIG. 2, each of the modules 18 contains a resistor 53 that is switched into and out of the circuit by a stationary contact 54 and a movable contact 55 which is controlled by the resistor operating mechanism. The size and rating of the resistors 53 will vary depending upon the surge impedance of the power line, the line voltage, etc. as disclosed in the aforementioned U.S. Pat. No. 3,291,947 (Van Sickle).

Figure 2A:
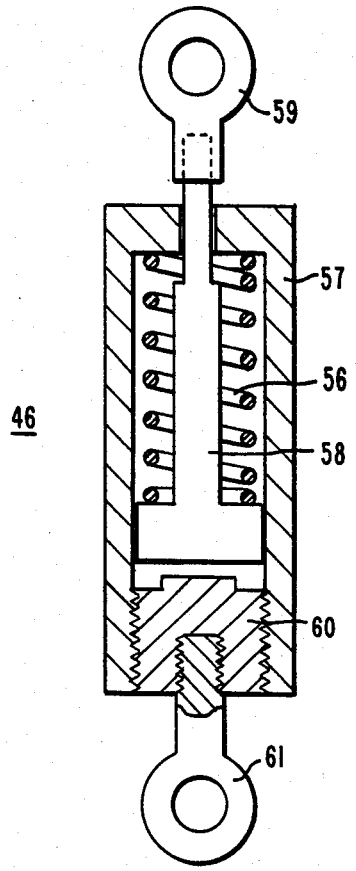
FIG. 2A is an enlarged cross-sectional view of the self-adjusting link component employed in the improved resistor operating and control mechanism of the present invention.

As shown more particularly in FIG. 2A, in the illustrated embodiment of the invention the elastic medial component 46 of the tie-rod assembly 45 comprises a helical spring 56 that is disposed within a cylindrical casing 57 in compressible relationship with a piston-like member 58 that is movable within the casing and has a protruding end portion that is fastened to an eyelet-like connector 59. The other end of the casing is closed by a plug 60 that is secured to another eyelet-like connector 61. The strength and size of the spring 56 is such that it exerts a tension in the tie-rod assembly 45 which "pulls" the resistor-operating lever 43 and circuit-breaker operating lever 44 together and thus automatically ensures that the drive shaft 42 is returned to the proper position after the circuit-breaker 10 has reached its "open-contact" condition, thus permitting the resistor-operating mechanism hereinafter described to be reset for the next cycle of breaker operation. The spring-loaded medial component 46 thus functions as a self-adjustable link in the tie-rod assembly 45 which prevents the erratic malfunctions of the circuit breaker 10 experienced when a rigid one-piece tie rod was heretofore employed.

Although the present invention can be advantageously employed in various types of circuit breakers (such as those which use oil, air or a vacuum as the insulating medium), it has here been illustrated in the form of a compressed gas power circuit breaker 10 of the so-called "puffer type" shown in FIG. 1. The present invention is more particularly concerned with an improved linkage and operating-control mechanism which will not only switch the closing resistors 53 into and out of the circuit, in a predetermined time sequence relative to the closing and opening of the circuit breaker contacts, but which will be automatically and reliably reset for the next cycle of circuit breaker operations. Positive and reliable automatic resetting of the closing resistor operating-control mechanism is of crucial importance since the closing resistors will not be inserted into the circuit unless such resetting occurs each time the circuit breaker is operated.

Figure 3:
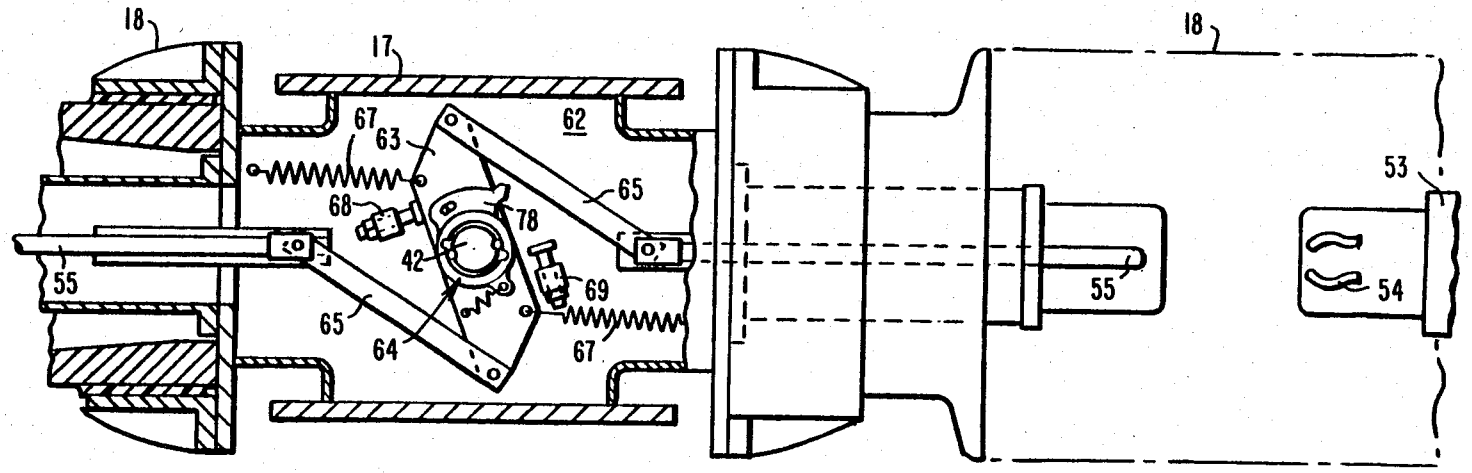
FIG. 3 is an enlarged fragmentary view, partly in section, of the resistor module portion of the circuit breaker showing the resistor operating-control mechanism and its internal linkage assembly.

As will be noted in FIGS. 1, 2 and 3, there are essentially three main subassemblies required to operate the resistor modules 18 and interrupter modules 20 of the power circuit breaker 10—namely, a breaker actuating-coupler means, an interrupter-contact operating mechanism, and an impedance-contact operating and control mechanism. The pneumatic operating mechanism 13, interrupter linkage 26, glass epoxy operating rods 22 in the support columns 16 and the interrupter and closing resistor linkage assembly 24 mounted externally at the top 17 of the associated support column 16 comprise the aforesaid breaker actuating-coupler means. Movement of the column operating rod 22 rotates link 52 which, in turn, causes the interrrupter operating lever 44 and resistor operating lever 43 (shown in FIG. 2) to rotate. This rotational movement is transferred to the movable breaker contacts 32 (by the phase lever system 49 and connector rods 33, 50) and to the resistor operating-control mechanism 62 (shown in FIG. 3) by the drive shaft 42 which is sealed through and extends into the housing 17 that encloses the resistor operating and control mechanism 62 (shown in FIG. 3). Since the resistor operating lever 43 is coupled to the breaker operating lever 44 by the self-adjusting tie-rod assembly 45 which includes the spring-loaded link 46, these two levers are resiliently connected to each other.

As shown in FIG. 3, the resistor operating-control mechanism 62 is located within the top portion 17 of the support column 16 (not shown) between the two associated resistor modules 18. As will be noted, the mechanism 62 is coupled to and driven by sealed drive shaft 42 and includes a drive lever 63 which forms part of a mechanical timing assembly 64 that automatically places the closing resistors 53 in the circuit, and subsequently removes them, in a prescribed time sequence relative to the closing and opening of the circuit breaker contacts 30, 32.

The timed insertion and removal of the closing resistors 53 is achieved by operating rods 65 which are linked to the drive lever 63 and moves the moveable resistor contacts 55 toward and into engagement with the respective stationary resistor contacts 54 when the drive shaft 42 is rotated in a clockwise direction and thus rotates the drive lever 63 in the same direction. The mechanical timing assembly 64 includes a pair of biasing springs 67 for the drive lever 63 and a pair of stops 68, 69 which coact to control the rotative movement of the various components of timing assembly. The drive shaft 42 and mechanical timing assembly 64 are depicted in FIGS. 3 and 4 in their reset positons with both the interrupter and resistor contacts in fully open position.

While the structural details and operation of the resistor actuating mechanism 62 and the mechanical timing and latch assembly 64 are basically the same as those disclosed in the aforementioned pending Calvino application Ser. No. 364,038, they will be briefly described to highlight the important improvement in the reset reliability of the circuit breaker 10 achieved by the present invention.

Figure 4:
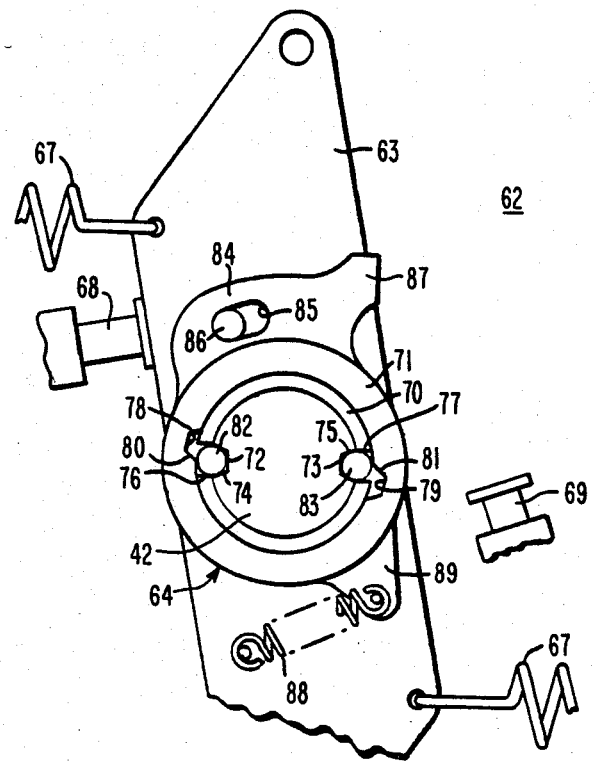
FIG. 4 is an enlarged elevational view of the drive arm and roller-latch assembly of the resistor operating-control mechanism shown in FIG. 3, with the various components in their "open contact" positions.
Figure 4A:
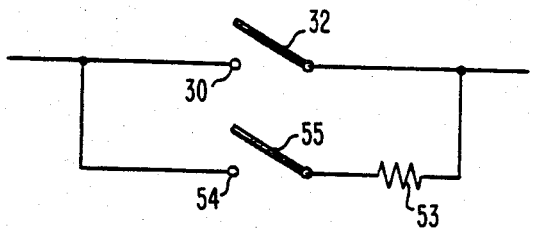
FIG. 4A is a schematic diagram showing the positions of the breaker contacts and closing resistor contacts corresponding to the "complete open" position of the resistor operating-control mechanism depicted in FIG. 4.

The resistor operating mechanism 62 and synchronizing timer-latch assembly 64 are shown in FIGS. 3 and 4 in their reset "open contact" positions (that is, with both the interrupter contacts 30, 32 and resistor contacts 54, 55 in their complete-open positions, as depicted in FIG. 4A). Drive shaft 42 is thus at rest at the beginning of the operating sequence and the circuit breaker 10 is ready to start a closing operation. As will be noted in FIG. 4, the timer-latch assembly 64 comprises an upstanding cylindrical collar 70 (that constitutes a part of the drive lever 63) and a free wheel cam 71 that are rotatably coupled to the drive shaft 42 and are also rotatable with respect to each other. The drive shaft 42 has a pair of oppositely-disposed peripheral slot openings 72, 73 that have tapered side walls 74, 75 and cooperate with a pair of apertures 76, 77 in the drive lever collar 70 and a pair of slot openings 78, 79 on the inner periphery of cam 71 to define a pair of continuous radial passageways (when the slots and apertures are all aligned with each other) which permit a pair of free rollers 82, 83, to move radially into and out of the two sets of slots 72, 73 and 78, 79. The side walls 80, 81 of the cam slots 78, 79 are tapered to force the rollers 82, 83 to move in a radial direction when the passageways are formed and the cam 71 is rotated relative to lever collar 70.

Figure 6:
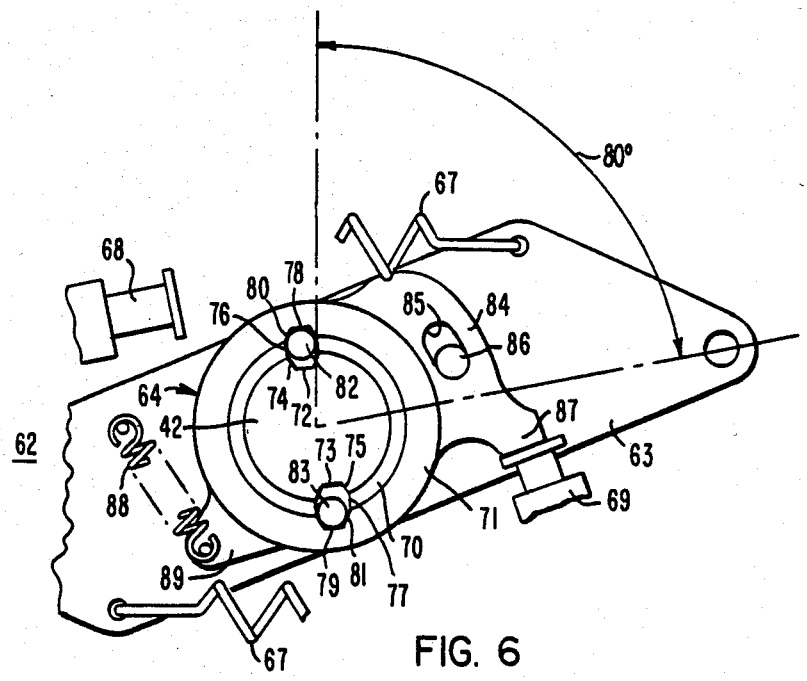
Figure 7:
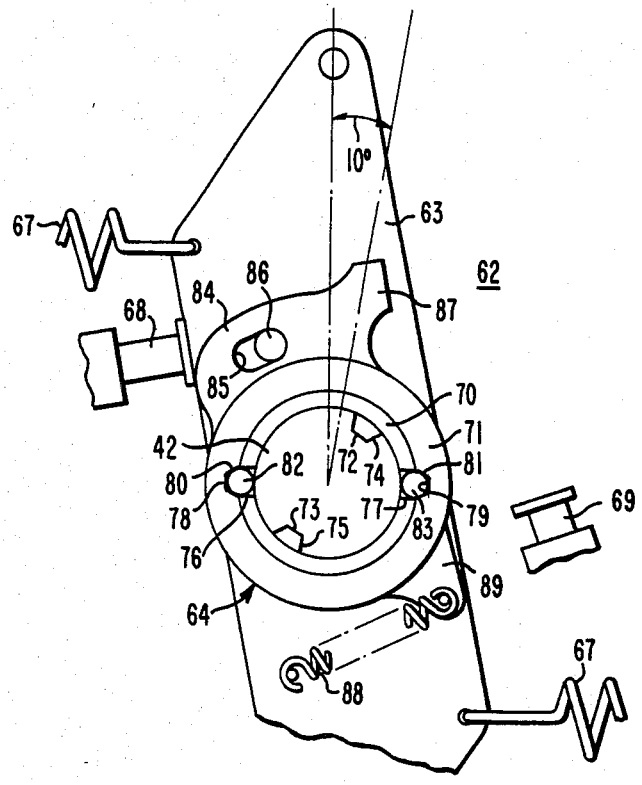

When the rollers 82, 83 are seated in the drive shaft slots 72, 73 and the aligned drive lever collar apertures 76, 77 (as shown in FIG. 4), the drive shaft 42 is coupled and latched to the drive lever 63 and they are then able to rotate as a unit when the drive shaft 42 is rotated by the circuit breaker operating mechanism 13 and its associated linkage. When the rollers 82, 83 are seated in the cam slots 78, 79, and aligned lever collar apertures 76, 77 (as shown in FIGS. 6 and 7), then the drive lever 63 and free wheel cam 71 are coupled to one another and are able to rotate as a unit. The drive lever 63 is biased by a pair of attached helical return springs 67 that are anchored to the support column housing and are oriented to return the drive lever 63 to its open-contact position against the adjustable stop 68.

The free wheel cam 71 has a restraining blade-like appendage 84 with an elongated slot-aperture 85 that engages a restraining pin 86 which protrudes from the underlying part of the drive lever 63. The cam appendage 84 also has a tongue-like segment 87 that is disposed to strike another adjustable stop 69 secured to the housing and located to limit the rotation of the free wheel cam 71 in a clockwise direction. Cam rotation in this direction is also constrained by a suitable biasing means, such as a spring 88, that is coupled to suitable pins on the drive lever 63 and a hanger 89 that laterally protrudes from the body portion of the cam 71. The action of spring 88 thus keeps the restraining pin 86 seated against the free wheel cam 71 at the end of the slot-aperture 85 when the timer-latch assembly 64 is in its reset "contact open" position shown in FIG. 4. The drive lever biasing springs 67 act to rotate the drive lever 63 in a couterclockwise direction and the free wheel cam biasing spring 88 acts to rotate the free wheel cam 71 in a clockwise direction relative to the drive lever 63, as these components are depicted in the drawings.

FIGS. 4 through 8 illustrate the resistor operating and control mechanism 62 and its timer-latch assembly 64 in various positions corresponding to the positions of the interrupter contacts 30, 32 and resistor contacts 54, 55 shown in the schematic diagrams FIGS. 4A through 8A, respectively. The aforesaid sets of contacts are shown schematically in the form of "single throw" type switches in FIGS. 4A to 8A for ease of illustration.

As stated previously, when both the interrupter contacts 30, 32 and the resistor contacts 54, 55 are open (as shown in FIG. 4A), the various components of the resistor operating mechanism 62 and timer-latch asssembly 64 are in the relative positions depicted in FIG. 4. When the circuit breaker 10 is actuated, the breaker operating mechanism 13 and its associated linkage system starts to close the interrupter contacts 30, 32 and thus causes the drive shaft 42 to rotate in a clockwise direction. The free rollers 82, 83 are then seated in the shaft slots 72, 73 (as shown in FIG. 4) and are kept in latched relationship with the drive shaft 42 and drive lever collar 70 by the inner rim of the slightly offset free wheel cam 71, thereby causing the drive lever 63 to rotate simultaneously with shaft 42 in a clockwise direction against the action of the helical return springs 67 which are attached to the drive lever 63. Free wheel cam 71 also rotates in a clockwise direction along with the drive lever 63 and shaft 42 since it is coupled to the drive lever 63 by the biasing spring 88. Since the drive shaft 42 is directly coupled to the moveable contacts 32 of both of the associated pair of interrupter units 20 and the drive lever 63 is directly coupled to the movable contacts 55 of the paired resistor modules 18, both the breaker contacts 30, 32 and resistor contacts 54, 55 begin to close when the drive shaft 42 and drive lever 63 are rotated together in a clockwise direction (as viewed in FIG. 4).

Figure 5:
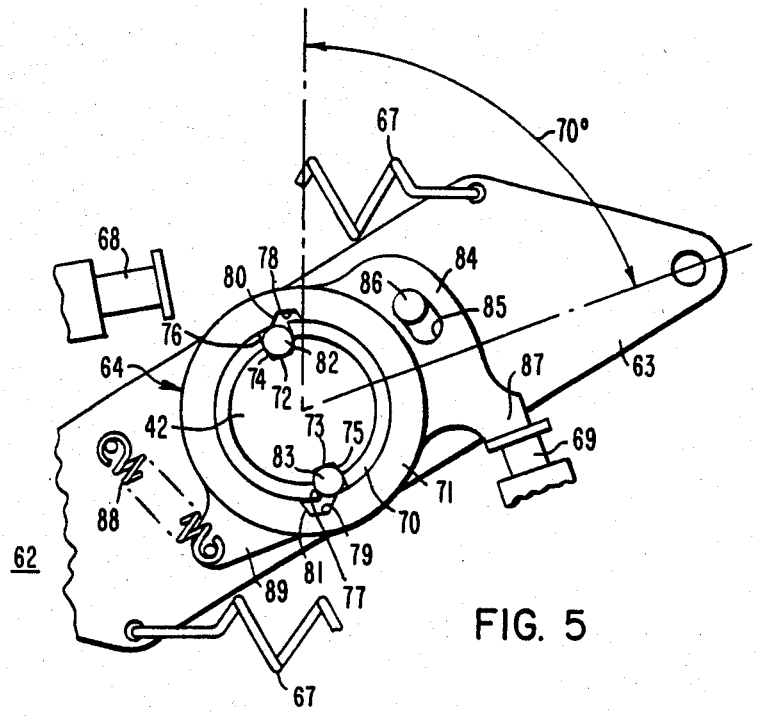
FIGS. 5 to 8 are enlarged elevational views of the resistor operating-control mechanism showing the relative positions of the drive arm and roller-latch assembly as the mechanism is first rotated in a clockwise direction (to effect the closure of the resistor and breaker contacts in a controlled time sequence) and then returned to its original position (to open the two sets of contact and reset the operating mechanism)
Figure 5A:
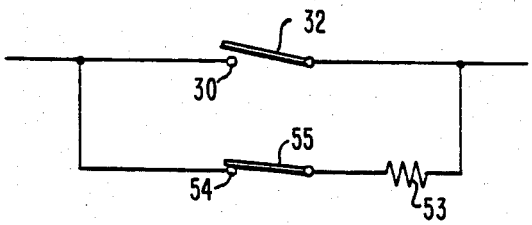

As shown in FIGS. 5 and 5A, simultaneous clockwise rotation of the drive shaft 42, drive lever 63 and free wheel cam 71 through an arc of approximately 70° during the closing operation of the circuit breaker 10 causes the resistor contacts 54, 55 to close and the breaker contacts 30, 32 to be positioned for imminent closure. Such rotation seats the tongue-like segment 87 of the free wheel cam 71 against the stop 69 and thus prevents further rotation of the cam.

Figure 6A:
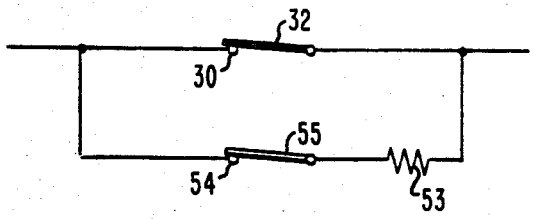

As shown in FIGS. 6 and 6A, as the drive lever 63 and roller-latched drive shaft 42 continue to rotate in a clockwise direction, the drive lever restraining pin 86 traverses the slot-aperture 85 in the cam appendage 84 and permits the roller-latched shaft 42 and lever 63 to rotate an additional 10° (for a total arc path of 80°), thus closing the interrupter contacts 30, 32 at a precisely controlled interval after the resistor contacts 54, 55 have been closed. The time delay provided by the additional 10° rotation of the drive shaft 42 closes the interrupter contacts 30, 32 approximately 10 milliseconds after the resistor contacts 54, 55 have been closed and the resistors 53 have been inserted into the circuit in parallel with the breaker contacts. Since the free wheel cam 71 remains stationary during the addtional 10° advance of the drive shaft 42 and and drive lever 63, the cam biasing spring 88 is placed in tension and the tapered slots 72, 73 in the cam 71 are brought into alignment with the tapered slots in the drive shaft 42 and apertures 76, 77 in the lever collar 70—thus providing a pair of unobstructed radial passageways and permitting the tapered sides 74, 75 of the shaft slots 72, 73 to force the free rollers 82, 83 to move radially into the cam slots 78, 79 and thereby latch the free wheel cam 71 to the drive lever 63 (as shown in FIG. 6). The drive shaft 42 is thus disengaged from both the cam 71 and drive lever 63 and the cam 71 and lever 63 are free to rotate in a counterclockwise direction (as a result of the pull exerted on the lever 63 by the tensioned return springs 67) while the drive shaft 42 continues its clockwise rotation to firmly seat the breaker contacts 30, 32 in closed position.

Figure 7A:
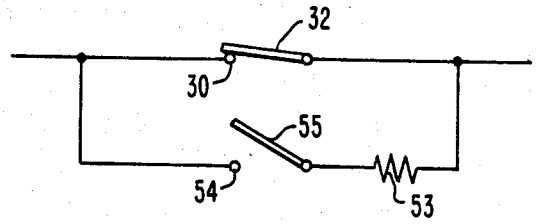

As shown in FIGS. 7 and 7A, such counterclockwise rotation of the drive lever 63 and cam 71 is arrested when the drive lever 63 engages the other stop 68 and the roller-latched lever 63 and cam 71 have rotated as a unit through an arc of 80°—thus fully opening the resistor contacts 54, 55 and removing the resistors 53 from the circuit a few milliseconds after the interrupter contacts 30, 32 have closed. Since the cam 71 is coupled to the drive lever 63 by the rollers 82, 83, the cam 71 remains in a 10° offset position relative to the lever (as indicated in FIG. 7) despite the tension in the cam spring 88.

Figure 8:
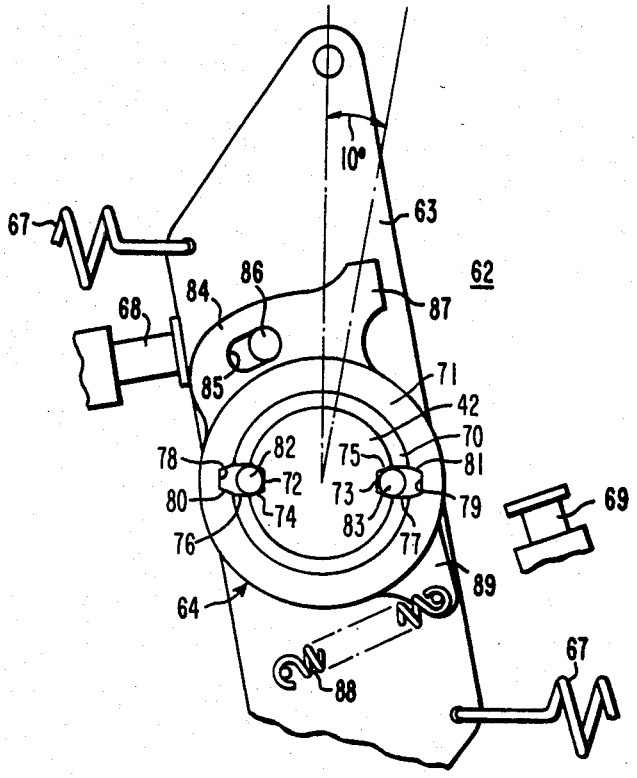
Figure 8A:
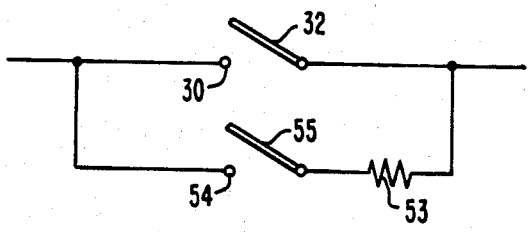

When the breaker operating mechanism 13 and its associated linkage system is actuated to open the interrupter contacts 30, 32, the resulting counterclockwise rotation of the drive shaft 42 returns the shaft slots 72, 73 into alignment with the lever collar apertures 76, 77 and the cam slots 78, 79, thereby again forming the unobstructed radial passageways for the free rollers 82, 83 (as shown in FIG. 8). The pull exerted on cam 71 by the spring 88 and the cam action exerted on the free rollers 82, 83 by the tapered sides 80, 81 of the cam slots 78, 79 forces the rollers to move radially and seat themselves in the tapered slots 72, 73 of the drive shaft 42 (also shown in FIG. 8). The cam 71 is thus no longer restrained by the rollers 82, 83 and is pulled in a clockwise direction by tensioned spring 88 and rotates through an arc of 10° (as permitted by the slot-aperture 85 in the cam appendage 84 and the coacting restraining pin 86 on the lever 63). The 10° rotation of the free wheel cam 71 restores the timer-latch assembly 64 and resistor-operating and control mechanism 62 to their starting positions shown in FIG. 4, thus resetting them for the next cycle of breaker operation and locking both the breaker contacts 30, 32 and closing resistor contacts 54, 55 in their complete-open positions (shown in FIG. 4A).

If the drive shaft 42 is not rotated in a counterclockwise direction during the breaker opening operation (by the breaker operating mechanism 13 and its associated linkage system) through an arc sufficient to perfectly align the tapered shaft slots 72, 73 with the apertures 76, 77 in the lever collar 70 and the tapered cam slots 78, 79 in the manner depicted in FIG. 8, then the unobstructed radial passageways will not be formed and the radial shift of the free rollers 82, 83 from their cam-latching position (shown in FIG. 7) to their shaft-latching position (shown in FIG. 8) cannot take place—with the result that the drive lever 63 will remain coupled to the cam 71. The resistor-operating mechanism 62 and timer-latch assembly 64 will thus not be reset in the proper manner (as shown in FIG. 4) and will be rendered inoperative during the next cycle of breaker operation. This problem is solved in accordance with the invention by the use of the self-adjusting elastic component 46 in the tie-rod assembly 45 which couples the resistor operating lever 43 to the breaker operating lever 44 (as illustrated in FIG. 2). The resulting "elastic coupling" of the levers ensures that the drive shaft 42 is rotated in a counterclockwise direction through an arc sufficient to align the shaft slots 72, 73 with the cam slots 78, 79 and drive collar apertures 76, 77 and permit the free rollers 82, 83 to shift position and again latch the drive shaft 42 with the drive lever 63 during the breaker-opening operation. The invention accordingly permits the circuit breaker 10 and its closing-resistor control mechanism 62 to operate and be reset in a positive and reliable manner automatically each time the breaker is cycled from contact-open to contact-closed condition—regardless of minor differences in the manufacturing tolerances of the various breaker components and resulting slight variations in the relative physical positions of such components which would render the closing resistor mechanism 62 and timer-latch assembly 64 inoperative.

I claim:

1. In a circuit interrupter having a pair of interrupter contacts that are movable into and out of engagement with one another in predetermined synchronized timed-sequence with a pair of impedance contacts that are also movable into and out of engagement with one another and, when engaged, connect a closing impedance means in parallel relationship with the interrupter contacts a controlled interval of time prior to the closing of said interrupter contacts, the combination comprising;

means for actuating the interrupter contacts including a first rotatable lever, means for actuating the impedance contacts including a second rotatable lever and a coupled timer-latch assembly that is adapted to control the opening and closing of the impedance contacts in accordance with said predetermined synchronized timed-sequence and is resettable so that the predetermined synchronized timed-sequence actuation of said interrupter and impedance contacts can be repeated each time the circuit interrupter is operated through a full cycle of circuit-opening and circut-closing operations, and means mechanically coupling said first and second rotatable levers to one another and having a component that automatically compensates for variations in the relative positions of said levers during the operation of the circuit interrupter which would prevent the timer-latch assembly from being reset and thus rendered inoperative to connect the closing impedance means in the circuit prior to the next closure of the interrupter contacts.

2. The combination of claim 1 wherein;

said first and second actuating levers are rotatable in the same direction when the interrupter contacts and the impedance contacts are being closed and are then both rotatable in the opposite direction when the interrupter contacts and impedance contacts are being opened, and the position-compensating component in said mechanical coupling means comprises a resilient link that is adapted to provide a force which pulls said first and second levers toward each other during the operation of the circuit interrupter.

3. The combination of claim 2 wherein said resilient link comprises a spring-loaded component that is secured to the respective actuating levers by rigid connector members and, together with said members, constitutes an elongated elastic tie-rod assembly.

4. The combination of claim 2 wherein;

only one of said interrupter contacts is movable and only one of said impedance contacts is movable, and said closing impedance means comprises a resistor that is connected to the stationary impedance contact.

5. The combination of claim 4 wherein said resilient link comprises a spring that is movably housed in a casing assembly which is coupled to the respective actuating levers by a pair of rigid connectors.

6. The combination of claim 5 wherein;

said spring is of helical configuration, said casing assembly is of cylindrical configuration and contains a movable piston-like member that is fastened to one of said connectors and is disposed to compress the spring when subjected to a pulling force by the fastened connector, and said rigid connectors and casing-enclosed spring assembly comprise a composite tie-rod assembly of elongated configuration.

7. The combination of claim 5 wherein;

said second rotatable lever is rigidly secured to a drive shaft which in turn, is coupled to a rotatable drive level by said timer-latch assembly, and said drive lever is connected by linkage means to the movable impedance contact.

8. The combination of claim 7 wherein said timer-latch assembly comprises;

a free wheel cam that is rotatably mounted on a cylindrical collar portion of said drive lever which, in turn, is rotatably mounted on said drive shaft, and a pair of free rollers that are radially movable from drive-shaft-latching position to drive-lever-latching position within radial passageways that are formed in predetermined timed-sequence by oppositely-disposed pairs of openings in the free wheel cam, drive lever collar portion, and drive shaft as the cam and drive lever and shaft are rotated relative to one another during the operation of the circuit interrupter.

* * * * *